United States Patent [19]

McBride et al.

[11] Patent Number: 4,846,845

[45] Date of Patent: Jul. 11, 1989

[54] PROCESS FOR PRODUCING SCULPTURED PILE FABRIC

[75] Inventors: Daniel T. McBride, Chesnee; Richard V. Gregory, Anderson, both of S.C.; Michael D. Morris, LaGrange, Ga.

[73] Assignee: Milliken Research Corporation, Spartanburg, S.C.

[21] Appl. No.: 219,498

[22] Filed: Jul. 11, 1988

[51] Int. Cl.[4] ..... D06Q 1/02

[52] U.S. Cl. ..... 8/114.6; 8/115; 8/128.3; 8/DIG. 21

[58] Field of Search ..... 8/114.6, 115

[56] References Cited

U.S. PATENT DOCUMENTS 4,353,706 10/1982 Burns, Jr. et al. ..... 8/114.6

*Primary Examiner*—Paul Lieberman
*Assistant Examiner*—John F. McNally
*Attorney, Agent, or Firm*—Terry T. Moyer; H. William Petry

[57] ABSTRACT

This invention provides a process for sculpturing pile fabrics which comprises: (a) selectively contacting the surface of a pile fabric corresponding to a pattern a fiber degrading composition, said composition comprising a fiber degrading agent in a concentration sufficient to reduce the tensile strength of the fibers of the pile, said fiber degrading agent being selected from a compound of the formula:

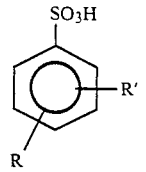

wherein R and R′ are each independently selected from a lower alkyl group having from one to about five carbon atoms, dyes are optionally selectively applied in pattern form and in register with the fiber degrading composition; (b) heating the pile fabric to temperatures above 180° F. but below 250° F., more specifically, heating with atmospheric steam to degrade the selected fibers of the pile and to provide fixation of the dyes; (c) the fiber degrading agent neutralizing with a solution of a base selected as a hdyroxide, carbonate, or phosphate of group I and II metals; (d) washing the pile fabric with water, to remove any residual components of the fiber degrading composition from the pile fabric; (e) conventionally drying the pile fabric; and (f) removing said selected and degraded portion of the fibers of the pile by mechanical means to provide a sculptured pile fabric.

11 Claims, No Drawings

PROCESS FOR PRODUCING SCULPTURED PILE FABRIC

The present invention relates to a sculptured pile fabric and to a process for producing such fabrics. More particularly, the present invention relates to a sculpturing process wherein the tensile strength of the fibers of the portions of the pile desired to be sculptured is reduced so that the pile may be removed in those selected areas by mechanical means.

In the production of pile fabrics, it is often desirable to provide a sculptured effect on the surface thereof in order to enhance decorative appeal. One of the early attempts to achieve such sculptured effect was by means of a heated embossing roll or plate which has been engraved or otherwise treated to create a desired design in raised relief on the surface of the pile fabric. Methods which have been proposed for the elimination of the use of embossing rolls include those disclosed in U.S. Pat. Nos. 2,790,255 and 2,875,504. As disclosed in these patents, the pile fabric is formed from a combination of shrinkable and nonshrinkable yarns; and upon subjecting the fabric to the influence of heat, the pile formed from the shrinkable yarns contracts while the base and nonshrinkable yarns remain intact, thereby yielding a pile having high and low areas to provide the appearance of an embossed or carved product.

Other sculpturing methods employing shrinking of the fibers by chemical means are known. It has thus been suggested, for instance, that pile fabrics, made from nylon carpet fibers having a textured or embossed surface, may be prepared by selectively contacting the surface of the carpet with a chemical fiber shrinking agent therefor, the shrinking serving to reduce the height of the pile in the treated areas, thereby creating a textured surface. In this regard, U.S. Pat. No. 3,849,157 discloses the use of an embossing agent blended into a liquid base vehicle containing a metal halide such as zinc chloride and an acid such as acetic acid which causes shrinkage of the pile fibers in the selected areas where it is applied. A similar process for providing an embossed effect on nylon pile fabric is disclosed in U.S. Pat. No. 3,849,158 where an embossing agent such as benzotriazole, hydroxyacetic acid, or formic acid, etc. causes a sculptured effect when it is applied by shrinking selected areas.

U.S. Pat. No. 3,856,598 discloses a process for producing texturized effects in a three component laminate which comprises applying a shrinking agent to the fibrous component of the laminate, drying the fabric and washing the fabric. The patent discloses many types of shrinking agents which may be used depending upon the nature of the components of the laminate. With regard to nylon, the shrinking agent is disclosed to be an acidic material having a dissociation constant greater than about $2\times10^{-5}$, such as mono and polybasic inorganic acids and organic acids, such as acrylic acid, formic acid, monochloroacetic acid, o-chlorobenzoic acid and even sulfonic acids, such as p-toluene sulfonic acid, benzene sulfonic acid, and phenols, such as m-cresol, and p-chlorophenol (Col. 4, lines 47–59). The patent emphasizes that the acid should be selected so as to minimize fiber degradation (Col. 4, lines 60–64).

A second category of what may conveniently be termed "chemical sculpturing methods" employs complete dissolution of the pile fibers which come into contact with the applied chemical-sculpturing agent.

Exemplary of what may be called the chemical fiber-dissolving type of sculpturing are the processes disclosed in U.S. Pat. Nos. 3,567,548 and 3,830,683. In the former patent a process is disclosed for the sculpturing of pile fibers, e.g., acrylic and polyester, by depositing polar solvent-containing solutions for the fiber in the pile, such as dimethyl formamide and dimethyl sulfoxide, having a viscosity of 500 to 1000 cps. According to the process a deep contour is provided in the fabric by totally dissolving portions of the pile fabric to which the solution has been applied. Similarly U.S. Pat. No. 3,830,683 discloses a process for embossing or sculpturing a tufted pile fabric printed with a decorative pattern. According to the disclosure the ink formulation used for printing the fabric contains a solvent for the carpet and the printing step is immediately followed by a steaming step, resulting in a combination of fiber shrinkage and dissolving to produce an embossed effect. The carpet may then be washed and dried to provide a carpet product having an embossed design.

Unfortunately, however, there have been problems associated with the use of the known methods for sculpturing pile fabrics that have prevented the production of a product at a reasonable price that is of very good quality. Use of a heated embossing roll results in the partial or complete melting of the embossed areas. Fibers may lose their individual integrity and become bonded together. The feel or hand of the embossed areas is often harsh and undesirable. The more recent embossing techniques have not been completely successful in overcoming these problems. Those processes which employ a chemical shrinking agent for the embossed areas have been generally unsatisfactory since the embossed areas tend to have a harsh and undesirable hand. Use of solvents to dissolve selected areas has been largely unsuccessful since the solvent may destroy the entire pile length in the areas to be embossed thereby exposing the backing of the fabric which may not be desired. Even if total dissolution of the pile is avoided fiber integrity may be destroyed and a harsh, undesirable hand may be the inevitable result.

Also, where shrinkage of the pile fibers is employed as the means for providing a sculptured effect, reduction in the overall pile height in general may not exceed more than about 40 percent without resulting in an undesirable loss of the fiber integrity and resultant undesirable hand and appearance. Such limitation may render the shrinking processes unusable where it is necessary or desirable to remove more than about 40 percent of the pile to achieve the desired aesthetic effect. This is particularly noticeable where the sculptured effect is desired in register with a printed pattern on the pile fabric where pile height reduction of 40 percent or less would not create a sufficiently striking visual effect to be of significant commercial importance. With fabrics having printed patterns it may be necessary to remove more than about 40 percent of the pile length in selected areas, e.g., 50 percent or even more, to provide the desired visual effect.

U.S. Pat. No. 4,353,706 discloses a process for sculpturing pile fabrics wherein loss of individual fiber integrity in the embossed areas is avoided. The length of pile remaining in the embossed areas are controlled so that only a portion of the pile is removed, or optionally the entire exposed portion of the pile is removed as desired. Pile fabrics, e.g., nylon pile fabrics, is provided having sculptured or textured surfaces with a superior hand by means of a process that is adaptable to standard known equipment for selectively dyeing pile fabrics in a pattern. This process also allows the production of nylon pile fabric having sculptured areas in register with a printed design.

The teachings of U.S. Pat. No. 4,353,706 provide a process for sculpturing a pile fabric, e.g., nylon pile fabric, which comprises selectively contacting the pile surface of the fabric with a fiber degrading composition, said composition comprising a fiber degrading agent in a composition sufficient to reduce the tensile strength of the fibers of the pile in selected areas so that said pile fibers may be removed by mechanical action; said fiber degrading agent being an alkylated aromatic sulfonic acid having a pK value of from about 0.1 to 2, and said fiber degrading composition further containing a diluent for said fiber degrading agent; heating said pile fabric to a temperature sufficient to cause the tensile strength of said fibers of said pile in the selected areas to be reduced sufficiently so that said fibers may be removed by mechanical means, but said temperature being low enough so as not to result in complete destruction of the fiber integrity prior to removal by mechanical means; and removing said degraded portion of said pile fibers by mechanical means to provide a sculptured pile fabric.

The fiber degrading agents taught in the process of U.S. Pat. No. 4,353,706 are benzene sulfonic acid, naphthalene sulfonic acid, and alkylated aromatic sulfonic acids having a pK value from about 0.1 to about 2, preferably from about 0.4 to about 1. Examples of the alkylated sulfonic acids cited include ortho-, meta-, and para-toluene sulfonic acids, and higher alkylated aromatic sulfonic acids wherein the alkyl group may be straight chain or branched chain and may contain from one to about 20 carbon atoms. Paratoluene sulfonic acid is cited as the preferred fiber degrading agent.

After the fiber degrading composition has been applied to the pile fabric, U.S. Pat. No. 4,353,706 teaches that the fabric is heated to a temperature sufficient to cause a substantial reduction of the tensile strength of the fibers, generally temperatures of from about 120° F. to about 250° F. may be employed. Steam may be conventionally used for this purpose, and if it is desired to employ elevated temperatures of about 212° F. in steaming, super-heated steam or pressurized steam may be used. The temperature to which the fabric is heated will vary depending upon the composition and resulting crystallinity characteristics of the substrate. Thus, nylon 6 fibers are heated to a preferred temperature range from about 120° F. to about 180° F. , while nylon 66 fibers are heated to somewhat higher temperatures of about 160° F. to about 250° F.

Although desired sculpturing results on pile fabrics composed primarily of nylon 6 fibers can be obtained using the cited process of U.S. Pat. No. 4,353,706 at the relatively low process temperature conditions of about 120° F. to about 180° F. All attempts at processing pile fabrics wherein the heat, steam above 180° F. to about 212° F., conventionally known to those skilled in the art as "atmospheric steaming conditions," degraded the selectively contacted areas of the pile composed primarily of nylon 6 fibers to an extent that the hand was very rough or the pile composed primarily of nylon 6 fibers was essentially completely degraded. It is also preferred by those skilled in the art that fixation of dyes to pile fabrics composed on nylon, wool or nylon wool blends take place at "atmospheric steaming conditions."

Accordingly, it is the main object of this invention to provide a process wherein pile fabrics composed primarily of but not limited to nylon 6 fiber be selectively contacted by a fiber degrading composition in a concentration sufficient to reduce the tensile strength of the fibers of the pile in the selected areas, said fibers being subjected to heating with atmospheric steam where the fibers of the pile are degraded and the dyes suitably fixed. Then, the fibers of the pile can be removed by mechanical action.

SUMMARY OF THE INVENTION

This invention provides a process for sculpturing pile fabrics which comprises: (a) selectively contacting the surface of a pile fabric corresponding to a pattern a fiber degrading composition, said composition comprising a fiber degrading agent in a concentration sufficient to reduce the tensile strength of the fibers of the pile, said fiber degrading agent being selected from a compound of the formula:

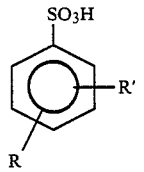

wherein R and R' are each independently selected from a lower alkyl group having from one to about five carbon atoms, dyes are optionally selectively applied in pattern form and in register with the fiber degrading composition; (b) heating the pile fabric to temperatures above 180° F. but below 250° F., more specifically, heating with atmospheric steam to degrade the selected fibers of the pile and to provide fixation of the dyes; (c) the fiber degrading agent neutralized with a solution of a base selected as a hydroxide, carbonate, or phosphate of group I and II metals; (d) washing the pile fabric with water, to remove any residual components of the fiber degrading composition from the pile fabric; (e) conventionally drying the pile fabric; and (f) removing said selected and degraded portion of the fibers of the pile by mechanical means to provide a sculptured pile fabric.

The pile fabrics which may be processed according to the present invention include virtually all pile fabrics, e.g, pile carpeting, upholstery and the like. Examples of fibers which compose the pile fabrics include synthetic fibers prepared from polyamides or nylons which are well known to those skilled in the art and natural fibers such as wool and blends of these fibers.

The preferred pile fibers employed in the process of the invention include nylon and nylon wool blends. Synthetic fibers prepared from polyamides or nylon are well known to those skilled in the art and as these terms are employed herein are intended to include any long chain polymeric amide which has recurring groups as an integral part of the main polymer chain and which is capable of being formed into a filament in which the structural elements are oriented in the direction of the axis of that chain.

Polyamide resins coming within the scope of the present invention are formed generally by reaction of the dicarboxylic acid with a diamine or by the self-condensation of an aminocarboxylic acid. Illustrative of these polyamide resins are nylon 66, prepared by the condensation of hexamethylenediamine and adipic acid, nylon 610 prepared by the condensation of hexamethylenediamine and sebacic acid, both of the foregoing having, as prepared, molecular weights of approximately 20,000 to 50,000 or more; nylon 6 produced by the self-condensation of epsilonamino caproic acid or caprolactam; nylon 11 produced by the self-condensation of 11-aminoundecanoic acid; as well as a variety of polymers prepared from polymerized debasic acids and polyamine compounds. The preferred fibers are nylon 6, nylon 66 and wool blends of these two nylons.

The fiber degrading composition of the process is applied to the pile fabrics in order to produce the desired sculptured effect. The fiber degrading composition contains a fiber degrading agent as the primary active component of the composition. For purposes of this invention, the term "fiber degrading composition" may be defined as any active chemical compound or composition which when applied to the pile fabric causes that portion of the pile to which it has been applied to become brittle or result in substantial reduction of the tensile strength of the portion of the fiber to which it has been applied without actually dissolving the fiber so that the degraded portion of the pile can be removed at a later stage in the process by mechanical means. The composition should be capable of being substantially removed or at least inactivated in subsequent sculpturing steps. Other characteristics of the fiber degrading or sculpturing compound which are desirable include compatibility with various dyes, thickeners and capability of being regulated by factors of time and concentration, enabling the temperature to be fixed at atmospheric steam conditions.

The fiber degrading composition which is applied to the pile fibers to obtain the desired sculptured effect contains a fiber degrading agent for the pile of the fabric. The fiber degrading agent should be present in the composition in a concentration sufficient to reduce the tensile strength of the fibers so that the fibers may be removed after the application of heat by mechanical means. The concentration of the sculpturing agent should not be so high as to result in complete destruction of the fiber integrity prior to subsequent removal thereof by mechanical means. It has been found that the fiber degrading agent, is preferably one or more of the isomers of xylene sulfonic acid, may preferably be present in the fiber degrading composition in an amount of from about 10 percent to 70 percent, preferably from about 15 percent to 50 percent by weight based upon the weight of the fiber degrading composition.

The fiber degrading agent is present in the fiber degrading composition together with a suitable diluent. The diluent may be a solvent for the fiber degrading agent, or alternatively if the agent is not soluble it should be present in the composition in a finely divided form, that is, it should be present in a micro-pulverized form which indicates particle diameter in the order of 100 microns or smaller, preferably even 20 microns or smaller. Such dispersion will assure that the agent becomes universally dispersed over the fiber during the process in the desired areas so that the degrading effect will be uniformly developed on the desired portions or all of the fiber. The fiber degrading composition may preferably include predominant amounts of water as a solvent for the fiber degrading agent, although other solvents, e.g., water, including methanol and ethanol may be employed. In any event it is believed that the alteration of the tensile strength of the fiber is caused by a hydrolysis reaction which results in breakage of the bonds of the molecules which make up the fiber. Thus hydrogen ions must be present at the site of the reaction together with the fiber degrading agent, and this may be conveniently accomplished by using water as a solvent.

The composition may further include a thickening agent, e.g., natural and synthetic gums and cellulose derivatives, by means of which the viscosity of the composition may be varied in a manner well known in the art in order to obtain the viscosity characteristics demanded in print technology and to enable the fiber degrading agent to adhere to and operate on the fiber and to hold the printed patterns. In general the viscosity of the composition may preferably be from about 100 to about 1000 cps, at 25° C., as measured by a Brookfield No. 3 spindle at 30 rpm.

The fiber degrading composition may be applied to the pile fabric in an amount of from about 50 percent to 500 percent, preferably 150 percent to 250 percent, by weight based upon the weight of the area of substrate to be sculptured. The fiber degrading composition may be applied to the pile fabric in the form of a substantially transparent composition so that the only alteration of the product is the sculpturing effect. Alternatively, the fiber degrading composition may be part of a dye or pigment composition used in printing the fabric so that the color appears in perfect register where the fiber degrading composition has been selectively applied. The dye or pigment may generally be in the form of a printing paste ink to which the appropriate amount of agent is added. In preparing such modified dye compositions, viscosities, and dye concentration which are essential to an efficient dyeing operation must also be controlled. The resultant effect is an embossed design in register with the printed pattern with color in the printed area.

With regard to the selected areas where the fiber degrading agent has been applied, the extent of pile removal and hence the depth of sculpturing may be controlled by varying the amount of fiber degrading composition applied or by varying the concentration of fiber degrading agent in the fiber degrading composition, or both. Furthermore, the amount of pile removed in the selected areas can also be controlled to a certain extent by the depth of penetration of the composition containing the fiber degrading agent into the pile of the fabric. Penetration can be controlled by varying, for instance, the viscosity of the chemical fiber degrading composition.

Application of the fiber degrading composition to the pile fabric may be accomplished by utilizing one of the many types of known printing apparatus thereby eliminating the need for expensive embossing or sculpturing equipment. Furthermore, it allows the sculpturing of a surface without exerting such pressure on the pile to result in permanent deformation of the fabric pile. In addition, because the sculpturing results from the removal of portions of the pile rather than by shrinkage of the pile in selected areas, the product typically has a much softer hand than would otherwise be provided for a given depth of sculpturing; and, also, exhibits all the advantages of products made by range printing techniques as opposed to woven fabric or hand sculptured fabric. The preferred apparatus for application of the fiber degrading composition may be a jet dyeing apparatus such as that disclosed in U.S. Pat. No. 4,084,615 to Norman E. Klein and William H. Steward, assigned to Milliken Research Corporation, the disclosure of which is hereby incorporated herein by reference.

After the fiber degrading composition has been applied to the pile fabric, the fabric is heated to a temperature sufficient to cause a substantial reduction of the tensile strength of the fibers. Although temperatures from about 120° F. to about 250° F. may be employed, atmospheric steaming conditions, temperatures above 180° F. to 212° F., are the preferred embodiment of the present invention.

Generally, the pile fabric may be subjected to heating for a time sufficient to cause degradation of the selected portions of the pile fabric. Where the heating means is steam, it has been found that heating should be for at least about one minute, preferably about three to about 30 minutes. The time of heating should be adjusted to result in the desired degree of degradation for the particular fiber substrate. Thus, if the time of treatment is too short, insufficient degradation will occur to allow for subsequent removal of the pile by mechanical means. If the time is too long, the pile may completely decompose which will result in an undesirable product having either no residual pile in the treated areas or an unpleasant hand in the embossed areas.

After steaming the pile fabric is preferably neutralized with a solution of a base selected as a hydroxide, carbonate or phosphate of group I and II metals. To eliminate the activity of the fiber degrading agent, this step in the process has been found to be extremely important to prevent further degradation of the fiber of the pile fabric during the lifetime of the finished pile fabric and to eliminate loss of color in adjacent colored areas to the sculpturing areas due to a reaction of active fiber degrading agent with the dyes used to color these adjacent colored areas. The pile fabric may then be washed with water to remove the components of the fiber degrading composition from the pile fabric.

As mentioned above, the selected areas of the pile fabric to which the pile degrading agent has been applied may be removed by mechanical means. Mechanical action to cause such removal may be initiated or even be accomplished totally during the washing step described above by simply spraying the washing solution onto the entire surface of the substrate at a high velocity. Alternatively the mechanical means by which the degraded portions are removed may be a simple beater which applies such action to the entire surface of the fabric from which degraded fibers are to be removed. In general the degree of mechanical action will depend upon the resultant tensile strength of the fiber after degradation in the areas to be sculptured. Mechanical removal of the degraded pile may be performed during the washing step as mentioned above or alternatively after washing but prior to drying or even after drying of the fabric.

A large number of products can be produced by the process of the present invention. The products can be used for floor, wall and ceiling coverings, drapery, upholstery and the like, and, in fact wherever pile fabrics are utilized. They are readily adaptable to decorating any surface on which pile fabrics can be applied. Many additional applications will occur to those skilled in the art.

The following examples are provided for illustrative purposes only and are not to be construed as limiting the subject matter of the invention in any way. Unless otherwise indicated, all parts and percentages are by weight.

EXAMPLE 1

In this Example, the process was performed on 100% Allied type 521 Perfect Luster, Anso IV, Nylon 6 and spun into a two-ply yarn. The Nylon 6 was in the form of a tufted carpet with a 1/10 inch tufting gauge, and 36 ounces per square yard weight and tufted into a nonwoven polypropylene back.

The carpet was first wetted to approximately 100%, based on the dry weight of the carpet (hereafter referred to as percent dry basis), with an aqueous solution of Xanthan gum to enhance the levelness of coexisting dyeing of the carpet. A fiber degrading composition was then applied to preselected areas of the carpet at approximately 250% dry basis. The remainder of the carpet was applied with a conventional aqueous acid dye solution. The application of the composition was by means of the apparatus described in U.S. Pat. No. 4,084,615. The fiber degrading composition was composed of Xanthan gum in sufficient amount to effect a viscosity of approximately 600 centipoise, as read by a Brookfield LVT viscometer, No. 3 spindle at 30 rpm, 2 weight percent mineral oil called Ortholube 100 available from Milliken Chemical, a division of Milliken & Company, and a fiber degrading agent at a concentration of approximately 26 weight percent of xylene sulfonic acid. The carpet was conventionally steamed at 212° F. for 8 minutes to activate the reaction between the fiber of the carpet and the fiber degrading composition and to fix the dye. The carpet was then washed in a 0.5 molar aqueous solution of sodium hydroxide to neutralize any unreacted fiber degrading agent. The carpet was then washed with water at approximately 70° F. to remove chemicals and Xanthan gum present in the fabric and conventionally dried at 230° F. Prior to the final carpet finishing the carpet was subjected to a mechanical beating action over the entire surface of the carpet and then vacuumed to remove the degraded fiber.

During and after the process the following observations were made:

(1) There was no reduction in pile height in the sculpturing areas or weight loss observed prior to steaming.

(2) A reduction of about 10 percent to about 20 percent in pile height in the sculptured areas was noticed after steaming. In these areas the fiber integrity was not altered but the fiber strength was dramatically reduced.

(3) After the mechanical action on the surface of the carpet, approximately 75 percent of the pile was removed in the preselected sculptured area in the form of a dust-like residue.

(4) The remaining fiber in the preselected sculptured area maintained fiber integrity and was substantially unaltered by the fiber degrading composition.

EXAMPLE 2

Example 1 was repeated except that the concentration of xylene sulfonic acid in the fiber degrading composition was increased from approximately 26 weight percent to approximately 33.5 weight percent. A very harsh and completely reacted fiber was observed after drying. Substantially all of the fiber was removed in the preselected sculptured areas.

EXAMPLE 3

Example 1 was repeated except that the concentration of the xylene sulfonic acid in the fiber degrading composition was decreased from approximately 26 weight percent to approximately 15 weight percent. Virtually no visible sculpturing had taken place in the preselected areas.

EXAMPLES 4–11

Example 1 was repeated except that the fiber degrading agent was para-toluene sulfonic acid (PTSA) at approximately 33.5 weight percent to approximately 26 weight percent in the fiber degrading composition (see Table I). These Examples clearly demonstrate no ability to control the pile height of carpet with PTSA.

TABLE I

| Example Number | Percent PTSA | Result |
|---|---|---|
| 4 | 33.5 | Very harsh, 100% sculptured |
| 5 | 31.5 | Same as Example 4 |
| 6 | 31.1 | Same as Example 4 |
| 7 | 30.1 | Same as Example 4 |
| 8 | 29.1 | Same as Example 4 |
| 9 | 28.0 | Less harsh, about 95% sculptured |
| 10 | 27.4 | Virtually no sculpturing |
| 11 | 26.0 | Same as Example 10 |

EXAMPLE 12

Example 1 was repeated except that the neutralization step in the process was omitted. The resulting sculptured carpet had substantial reduction in the fastness to light of the dyed portion of the carpet adjacent to the preselected sculptured areas.

EXAMPLE 13

Example 1 was repeated except that the carpet was 21 ounces per square yard weight, one-fourth inch height, composed of continuous single ply nylon 6 fiber from Denmark and the fiber degrading composition was decreased from 26 weight percent to approximately 23 weight percent. The sculptured areas had a visual reduction in pile height of approximately 80 percent.

EXAMPLE 14

Example 2 was repeated except that the carpet was 34.5 ounces per square yard, 1/10 inch tufting gauge, and composed Type P452 Dupont Regular Dye, Antron III, continuous filament, Nylon 66. The sculptured areas had a visual reduction in pile height of approximately 60 percent.

EXAMPLE 15

Example 1 was repeated except that the carpet was 100 percent New Zealand wool, 1/10 inch tufting gauge, 14.5 tufting stitches per inch, 50 ounces per square yard weight and the carpet was pretreated in a manner described by U.S. Pat. No. 4,415,331 before application of the fiber degrading composition. The fiber degrading agent was increased from approximately 26 weight percent to about 30 weight percent in the fiber degrading composition. The sculptured areas had a visual reduction in pile height of approximately 80 percent.

What is claimed is:

1. A process for sculpturing a pile fabric having pile fibers selected from nylon, wool, and nylon-wool blends which comprises: (a) selectively contacting in a pattern the surface of a pile fabric with a fiber degrading composition, said composition comprising a fiber degrading agent in a concentration sufficient to reduce the tensile strength of the fibers of the pile, said fiber degrading agent being selected from a compound of the formula:

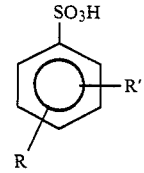

where R and R′ are each independently selected from a lower alkyl group having from 1 to about 5 carbon atoms; (b) heating the pile fabric to a temperature of from about 180° F. to about 250° F. to degrade fibers of the pile fabric to which the fiber degrading composition have been applied; (c) neutralizing said fiber degrading agent; and (d) removing said pile fibers which have been degraded by mechanical means to provide a sculptured pile fabric product.

2. The process of claim 1 wherein dyes are applied to said pile fabric in pattern form and in register with said fiber degrading composition.

3. The process of claim 2 wherein said pile fabric is washed after neutralizing.

4. The process of claim 3 wherein said neutralizing is accomplished by application of a solution of a base selected from hydroxides, carbonates, and phosphates of group I and group II metals.

5. The process of claim 4 wherein said pile fabric is dried after washing but prior to removal of selected portions of the pile fibers by mechanical means.

6. The process of claim 5 wherein said fiber degrading agent is present in said fiber degrading composition in a concentration of about 10 percent to 70 percent by weight based upon the total weight of the composition.

7. The process of claim 6 wherein said heating is caused by the application of steam for at least about one minute.

8. A process for sculpturing a pile fabric characterized as having pile fibers selected from nylon, wool, and nylon wool blends with a fiber degrading composition, which comprises selectively contacting the pile surface of said pile fabric with a fiber degrading composition comprising a fiber degrading agent in a concentration sufficient to reduce the tensile strength of the fibers of the pile, said fiber degrading agent being selected from a compound of the formula:

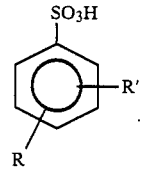

wherein R and R′ are each independently selected from a lower alkyl group having from 1 to about 5 carbon atoms, said selective contacting being accomplished by means of a jet dyeing apparatus including conveying means for transporting the fabric, jet orifices for delivering fiber degrading composition in a pattern to said textile material and controlling means for supplying data to control the operation of the application of fiber degrading composition from the jet orifices to the fabric, said process further comprising the steps of heating said pile fabric to a temperature sufficient to cause the tensile strength of said fibers of said pile on the selected areas to be reduced sufficiently so that said fibers may be removed by mechanical means, but said temperature being low enough so as not to result in the complete destruction of the pile integrity prior to removal by mechanical means; and removing said degraded portion of said pile fibers by mechanical means to provide a sculptured pile fabric.

9. The process of claim 8 wherein said pile fabric is neutralized after application of said fiber degrading composition.

10. The process of claim 9 wherein said pile fabric is washed after neutralizing.

11. The process of claim 10 wherein said pile fabric is dried after washing, but prior to removal of said degraded portion of said pile fibers.

* * * * *